US006481966B2

(12) United States Patent
Beeck et al.

(10) Patent No.: US 6,481,966 B2
(45) Date of Patent: Nov. 19, 2002

(54) BLADE FOR GAS TURBINES WITH CHOKE CROSS SECTION AT THE TRAILING EDGE

(75) Inventors: Alexander Beeck, Küssaberg (DE); Jörgen Ferber, Küssaberg (DE); Christoph Nagler, Zürich (CH); Lothar Schneider, Waldshut-Tiengen (DE); Klaus Semmler, Dachau (DE)

(73) Assignee: ALSTOM (Switzerland) Ltd, Baden (CH)

( * ) Notice: Subject to any disclaimer, the term of this patent is extended or adjusted under 35 U.S.C. 154(b) by 0 days.

(21) Appl. No.: 09/739,282

(22) Filed: Dec. 19, 2000

(65) Prior Publication Data

US 2001/0012484 A1 Aug. 9, 2001

(30) Foreign Application Priority Data

Dec. 27, 1999 (DE) ..... 199 63 349

(51) Int. Cl.[7] ..... F01D 5/18
(52) U.S. Cl. ..... 416/97 R; 415/115
(58) Field of Search ..... 415/115, 116; 416/96 R, 96 A, 97 R, 97 A

(56) References Cited

U.S. PATENT DOCUMENTS

| | | | | |
|---|---|---|---|---|
| 4,173,120 A | | 11/1979 | Grosjean et al. | |
| 4,286,924 A | | 9/1981 | Gale | |
| 4,292,008 A | | 9/1981 | Grosjean et al. | |
| 4,835,958 A | | 6/1989 | Rice | |
| 5,243,759 A | | 9/1993 | Brown et al. | |
| 5,368,441 A | * | 11/1994 | Sylvestro et al. | 416/97 R |
| 5,669,759 A | * | 9/1997 | Beabout | 416/97 R |
| 5,857,837 A | * | 1/1999 | Zelesky et al. | 416/97 R |
| 5,864,949 A | | 2/1999 | Kildea | |
| 5,975,851 A | * | 11/1999 | Liang | 416/97 R |
| 6,139,269 A | * | 10/2000 | Liang | 416/97 R |
| 6,179,565 B1 | * | 1/2001 | Palumbo et al. | 416/97 R |
| 6,234,754 B1 | * | 5/2001 | Zelesky et al. | 416/97 R |

FOREIGN PATENT DOCUMENTS

| | | |
|---|---|---|
| EP | 0 924 383 A2 | 6/1999 |
| GB | 1 605 180 | 1/1983 |

OTHER PUBLICATIONS

G. Wilfert, L. Fottner, Aerodynamik der Filmkuhlung, In: FW, H. 573, 1994 Abb.2.5, Bezug TIB Hannover: RA 1581 (573).

* cited by examiner

*Primary Examiner*—F. Daniel Lopez
*Assistant Examiner*—James M McAleenan
(74) *Attorney, Agent, or Firm*—Burns, Doane, Swecker & Mathis, L.L.P.

(57) ABSTRACT

In a gas-turbine guide element (30) around which a hot air flow (23) flows and which, at least in a trailing edge region (21), in which the air flow (23) separates from the guide element (30), comprises at least two walls (10, 11) arranged essentially in parallel and connected to one another by ribs (16, 17, 20) in such a way as to form internal cooling passages (18, 19, 25, 26, 27), and which is cooled on the inside with cooling medium (28, 29) flowing through the cooling passages (18, 19, 25, 26, 27), the cooling medium discharging from the guide element (30) at the trailing edge (21) essentially parallel to and between the walls (10, 11), and in a method of producing it, easier reworking and less susceptibility to foreign particles are achieved owing to the fact that at least some of the ribs are arranged as choke ribs (24) so as to terminate essentially flush with the trailing edge (21).

11 Claims, 4 Drawing Sheets b)

BLADE FOR GAS TURBINES WITH CHOKE CROSS SECTION AT THE TRAILING EDGE

BACKGROUND OF THE INVENTION

The present invention relates to the field of guide elements, such as guide or turbine blades, used in gas turbines. It concerns a gas-turbine guide element around which hot air flows and having a trailing edge region at which the air flow separates from the guide element. At least the trailing edge region includes at least two walls arranged essentially in parallel and connected to one another by ribs in such a way as to form internal cooling passages. The guide element is cooled on the inside with cooling medium flowing through the cooling passages, the cooling medium discharging from the guide element at the trailing edge essentially parallel to and between the walls.

A gas turbine includes a multiplicity of components which are subjected to a flow of hot working air. Since the working air is at a high temperature which may lead to pronounced wear phenomena on many of the components, in particular during a prolonged operating period, it is necessary to cool many of these components. The cooling may be designed as internal cooling, in which the elements are designed as hollow profiles or are simply provided with internal cooling passages through which a cooling-air flow is directed. Alternatively or in addition, it is also possible to provide film cooling, in which a cooling-air film on the outside is applied to the elements.

Modem gas-turbine blades generally use a combination of the above methods, i.e. an internal convective cooling system which additionally has openings for film blowing at critical points is used. In order to increase the efficiency and the output of the gas turbine, and in order to reduce the emissions, the quantity of cooling air used must be minimized. This means that only a small cooling-air mass flow is available even for large components. In order to realize and control the small cooling mass flows with efficient internal heat transfer, which is required at the same time, the cross sections of flow must be reduced accordingly, or choke cross sections must be introduced.

In many of the known blade designs, the choking of the cooling mass flow takes place in the region of the trailing edge of a cast blade, in the vicinity of the cooling-air outlet. For reasons including production reasons, the end of the ribs which connect the pressure-side and suction-side walls in conventional blades are set back in the axial direction in order to avoid core fractures, i.e., the ribs end in the interior of the blade and do not extend up to the trailing edge.

FIG. 1 shows a section through a conventional guide blade, as often used in gas turbines. This is a section through a guide blade as typically used directly downstream of the combustion chamber and in front of the first moving row of the gas turbine. The section is taken axially to the main axis of the turbine and perpendicularly to the blade-body plane. The guide blade provides optimum incident flow to the moving blades. The blade is designed as a hollow profile, which is defined on the suction side by a wall 10 and on the pressure side by a further wall 11. In the incident flow region, the blade is widened, the walls 10 and 11 are connected to one another in a rounded portion, and a central, radially running insert 12, around which the cooling passage leads, is located between the walls 10 and 11. In the rear or trailing edge region, the guide blade 30 is defined only by the two walls 10 and 11, and cooling passages run in between the walls 10 and 11, which are connected to one another by interrupted ribs running in the axial direction. The central insert 12 is often completely or partly enclosed by approximately axially running ribs. These ribs converge at the rear end of the insert (16 in FIG. 1) and from this point on connect the suction- and pressure-side blade walls. Approximately axial passages, in which the cooling air is directed, are formed between the ribs.

In its further course, the rib bank may be interrupted in order to produce a plenum 18 running in the radial direction. The following rib bank 17 may be arranged both in line with or offset from the previous rib bank. In the region of the trailing edge, the pressure and suction-side walls are connected to one another by very short ribs or pin rows. In conventional guide blades, the built-in components, such as the ribs and pins, are positioned inwardly from the blade ends. This avoids the situation in which the core required for casting the blade has a large change in cross-sectional area at the trailing edge. A considerable nonuniformity in the core cross-sectional profile leads to a high number of core fractures during production. However, the above-described conventional method for forming a blade has the considerable disadvantage that the outlet cross section of the cooling air and thus of the cooling-air mass flow can not be adequately controlled.

In addition, the walls of a guide blade usually have film-cooling holes 13–15, through which cooling air can flow to the outside.

This configuration of the internal convective cooling system has a number of disadvantages:

Since the cross section is small, even small tolerances during the production (casting) have an effect on the cooling-air mass rate of flow.

Since the choke point lies in the interior of the guide element, the effective choke cross section can only be measured and checked with difficulty.

Since the choke edge lies in the interior of the guide element, the effective choke cross section can only be subsequently modified with difficulty.

The two usually very thin walls are extremely susceptible to damage which is caused by foreign bodies in the hot gas and which may possibly even lead to a change in the choke cross sections.

Due to the gradual expansion of the cooling air (1) at the end of the ribs and (2) at the trailing blade edge, the cooling-air mass flow can be controlled and adjusted only with difficulty.

SUMMARY OF THE INVENTION

In view of the above-discussed disadvantages of conventional gas-turbine guide elements, the invention provides a gas-turbine guide element around which a hot air flows. The guide element has a trailing edge region at which the air flow separates from the guide element, with at least the trailing edge region including at least two walls arranged essentially in parallel and connected to one another by ribs in such a way as to form internal cooling passages. The guide element is cooled on the inside with cooling medium flowing through the cooling passages, and the cooling medium discharges from the guide element at the trailing edge essentially parallel to and between the walls.

The invention provides the guide element of the type described above with at least some of the ribs arranged so as to terminate essentially flush with the trailing edge. The arrangement of some of the ribs connecting the walls directly at and essentially flush with the trailing edge makes these ribs and the passages in between them more accessible and stabilizes the walls in the edge region more effectively. As a result, the walls in the trailing edge region are substantially less susceptible to damage caused by foreign bodies entrained in the working air flow. In addition, the rate of flow of cooling medium between the ribs arranged at the trailing edge can be reworked or adapted substantially more easily than with conventional guide elements after the production process or during maintenance as a result of the good accessibility.

In a first embodiment of the invention, the rate of flow of cooling medium through the guide element is essentially determined by the dimensioning of the outlet openings arranged between the ribs at the trailing edge, generally referred to as choke ribs. The better accessibility and ease of reworking due to the arrangement are especially advantageous when the choking of the cooling-air circulation is effected by the choke ribs arranged at the trailing edge, and the choking can easily be set or even measured from outside by boring or other processes.

In another embodiment of the invention, the thickness of the guide element at the trailing edge is within a range of 0.5 to 5 mm, in particular preferably within a range of 1.0 to 2.5 mm. The slot thickness of the cooling-air passages between the walls at the outlet is within a range of 0.3 to 2 mm, in particular within a range of 0.8 to 1.5 mm. If the guide element is designed as a guide blade arranged in front of a turbine rotor, and if the cooling medium used is air, the arrangement according to the invention and this dimensioning proves to be especially advantageous.

The invention also includes a method of producing a gas-turbine guide element for the guidance of hot air. The gas-turbine guide element includes a trailing edge region, at which the air flow separates from the guide element. At least the trailing edge region includes at least two walls arranged essentially in parallel and connected to one another by ribs in such a way as to form internal cooling passages. The guide element is cooled on the inside with cooling medium flowing through the cooling passages, the cooling medium discharging from the guide element at the trailing edge essentially parallel to and between the walls. The method of producing the guide element includes a casting process. During the casting process the trailing edge region is cast with a projecting length extending the walls of the guide element in the direction of flow. The projecting length is removed after the casting in such a way that at least some of the ribs are arranged as choke ribs so as to terminate essentially flush with the trailing edge. In this case, the casting core is formed in such a way that the rib geometry beyond the trailing edge of the blade is modeled in the casting core. The rib geometry is not blanked out until after a length of about 0.5 to 5 times, or more preferable 1 to 3 times, the core thickness. This method makes the simple production of a guide element according to the invention possible for the first time. This is because, in a normal casting process, the effective choke cross section cannot easily be placed directly at the outlet edge. The abrupt widening in the cross section at the outlet in the casting core leads to a considerable increase in core fractures during production. However, this problem with conventional casting processes has been avoided by the method of this invention wherein a projecting length is left on the guide element during the casting process.

In a preferred embodiment of the method according to the invention, no ribs are arranged between the walls in the region of the projecting length, and the rate of flow of cooling medium through the finished guide element is essentially determined by the dimensioning of the outlet openings arranged between the choke ribs. By avoiding having any ribs in the region of the projecting length, core fractures can largely be avoided during the casting process, in particular during the preferred pressure casting process (investment casting). Furthermore, it is found that, if the projecting length value is 0.5 to 3 times as large as the slot thickness of the cooling air passages, or more preferably the same size as the slot thickness of the cooling-air passage between the walls, such core fractures can be avoided without the need for excessive reworking after production.

BRIEF DESCRIPTION OF THE DRAWINGS

The invention is explained in more detail below with reference to exemplary embodiments in connection with the drawings, in which.

DESCRIPTION OF THE PREFERRED EMBODIMENTS

Figure 1:
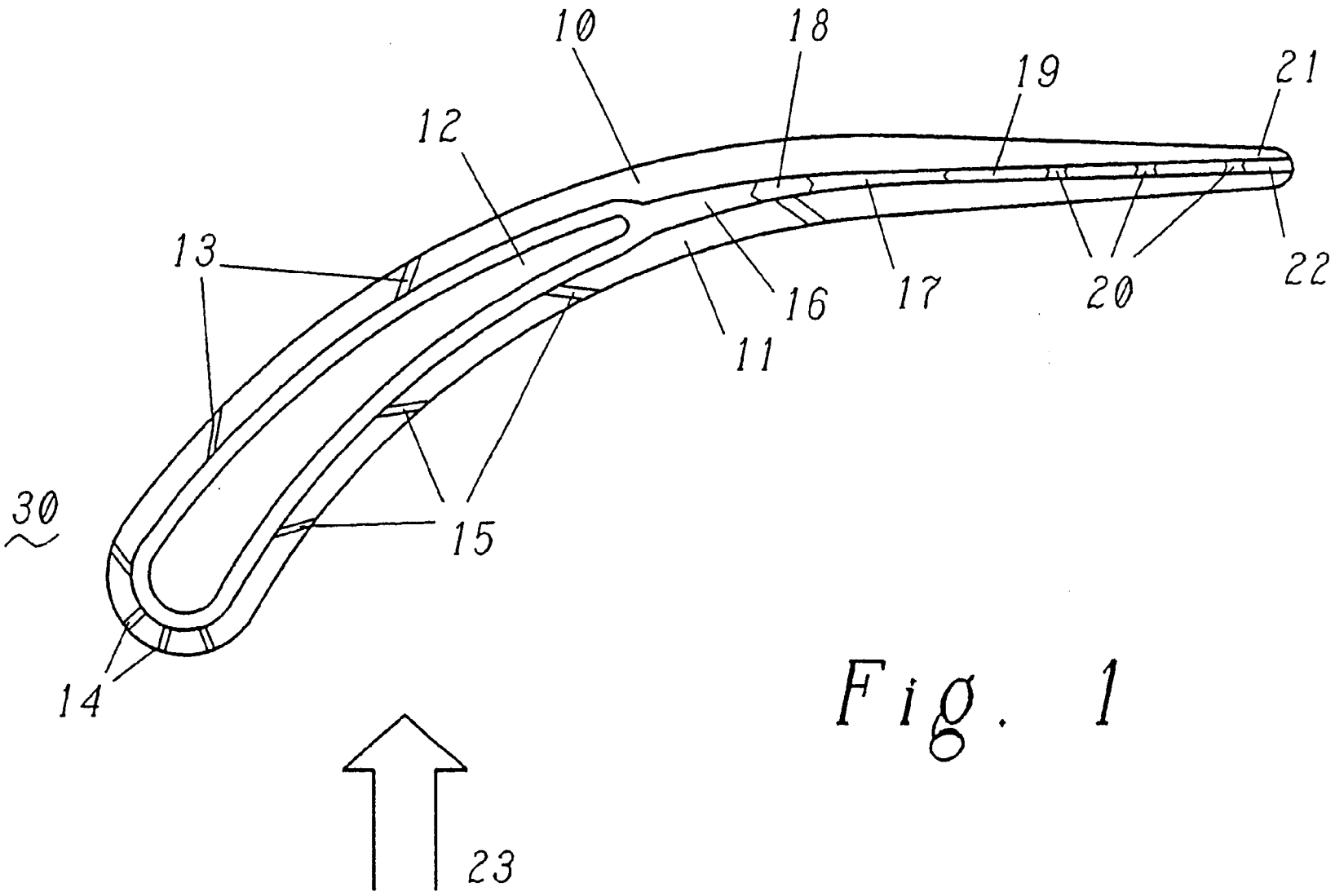
FIG. 1 shows a cross section through a conventional guide blade with internal cooling for a gas turbine.
Figure 2:
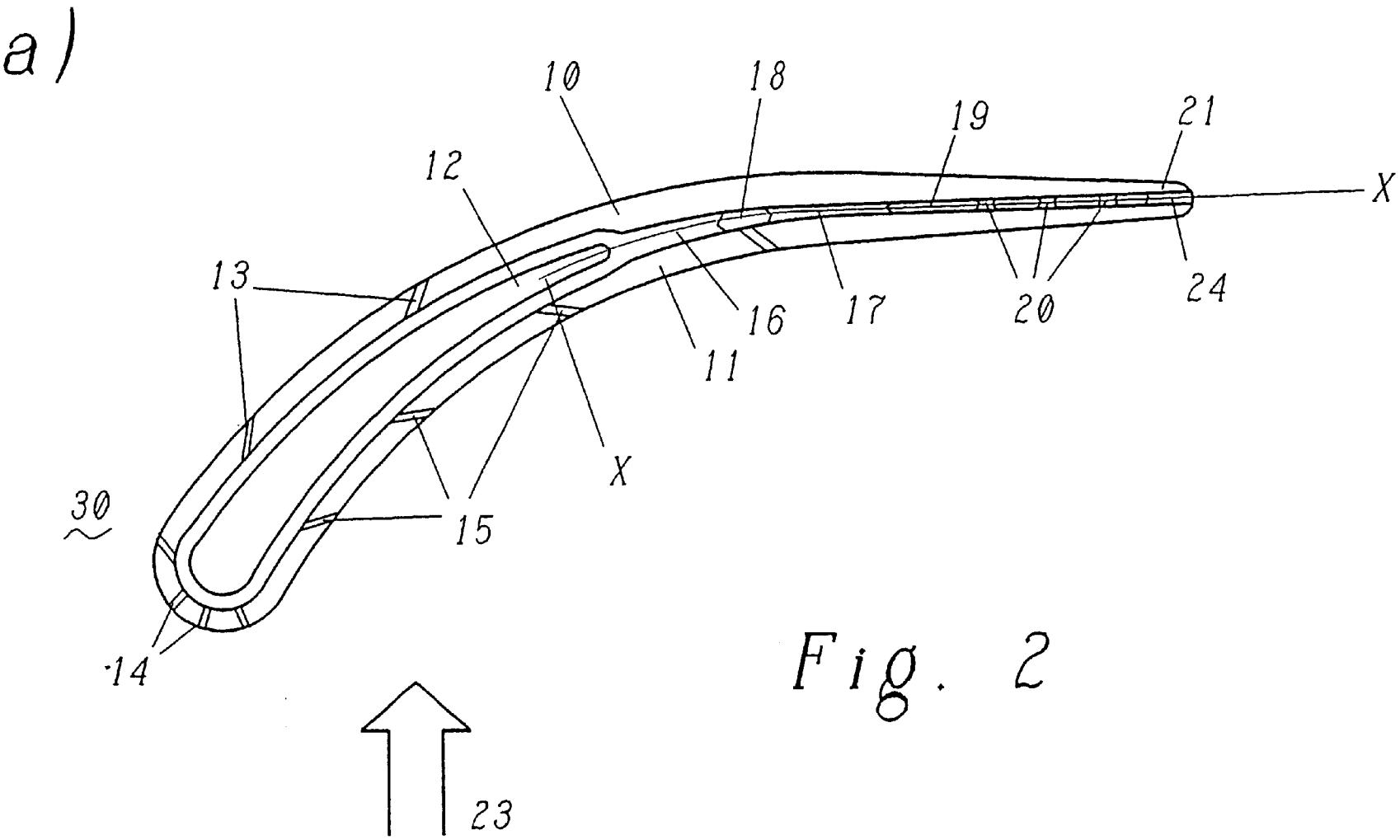
FIG. 2*a*) shows a cross section through a guide blade with choke ribs arranged directly at the trailing edge of the blade.
FIG. 2*b*) shows a detail view of the trailing-edge region of the blade shown in FIG. 2*a*)
FIG. 2*c*) shows a sectional view taken along line X—X in FIG. 2*a*), i.e. essentially parallel to the plane of the blade through the internal cooling passage.
Figure 2:
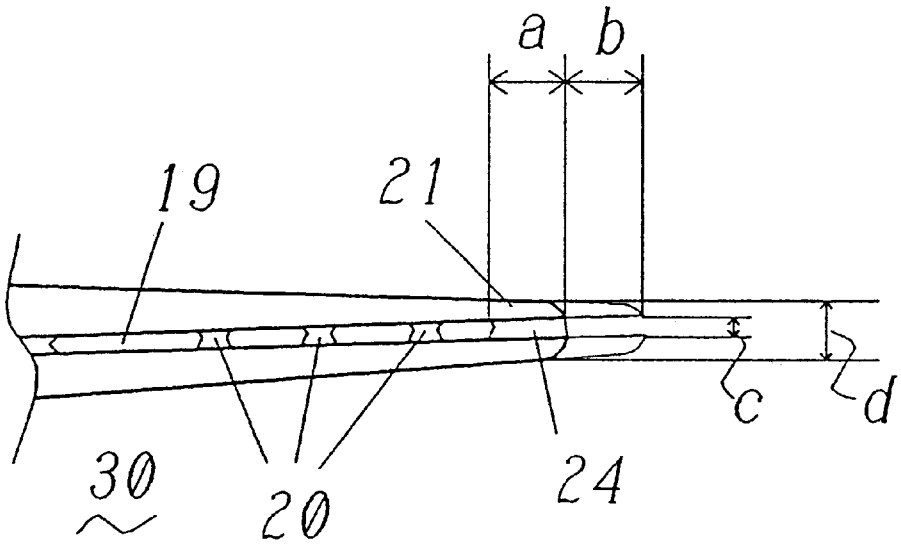
Figure 2:
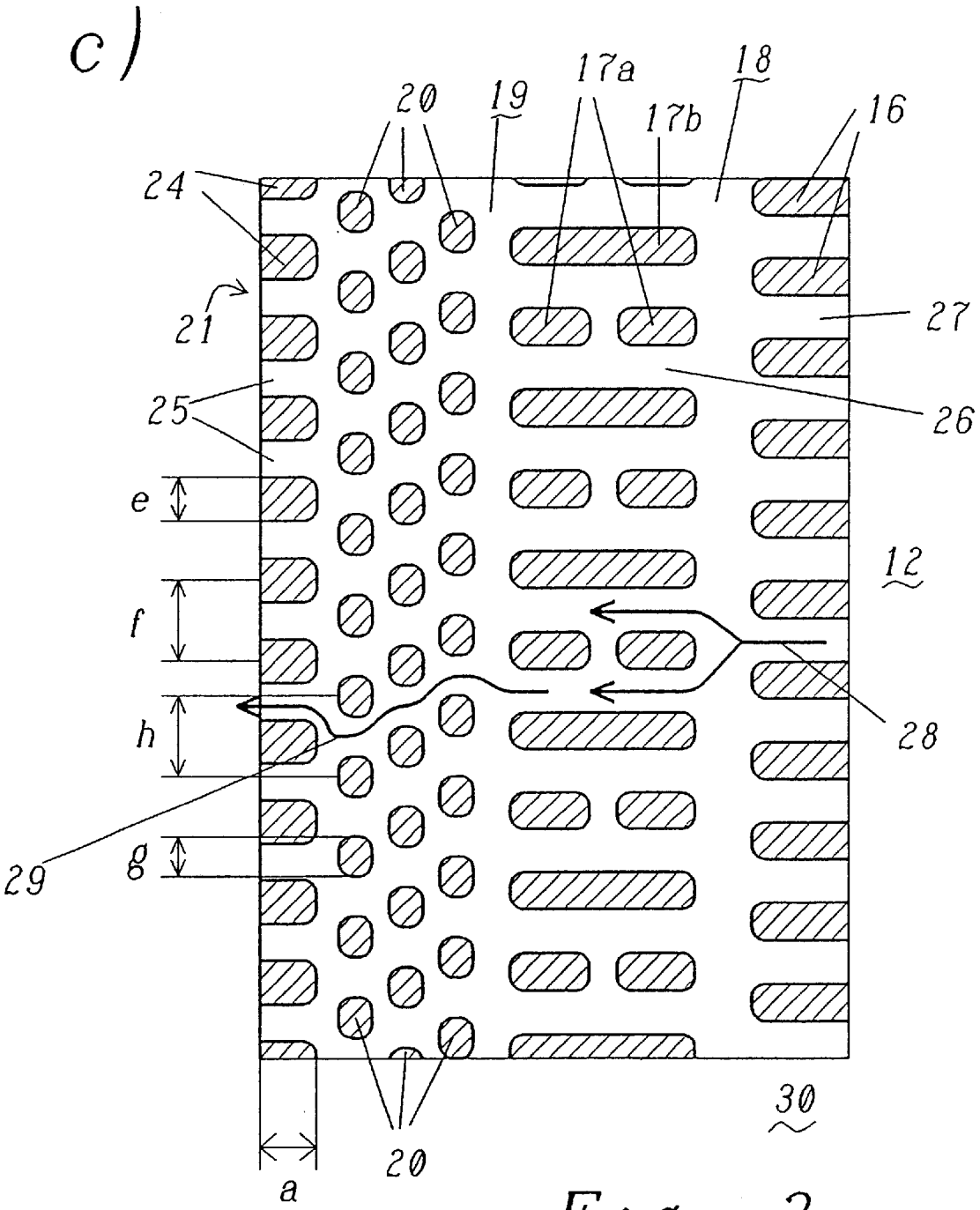

FIG. 2*a*) shows a section through a guide blade having ribs 24 directly adjacent to the trailing edge between the walls 10 and 11. This section through a guide blade is a section corresponding to FIG. 1 and running axially to the main axis of the turbine and perpendicularly to the blade-body plane. The blade is again designed as a hollow profile, which is defined on the suction side by a wall 10 and on the pressure side by a further wall 11. In the rear or trailing edge region, the guide blade is defined only by the two walls 10 and 11, and cooling passages run in between, the walls 10 and 11 being connected to one another by ribs interrupted in the radial direction. FIG. 2*c*) shows a section along line X—X in FIG. 2*a*), i.e., essentially parallel to the blade-body plane. First ribs 16 are located directly adjacent to the insert 12. The cooling air flowing between insert 12 and the walls 10 and 11 flows essentially axially in the passages 27 between the ribs 16 into the rear region of the guide blade. Located behind the first row of ribs 16 is a front radial plenum 18, which permits a flow and pressure balance of the cooling air in the radial direction. Adjoining the plenum 18 is a further row of ribs 17, which in this example are alternately designed as continuous ribs 17*b* or as axially split ribs 17*a*. The individual ribs of the rows 16 and 17 advantageously have a spacing ratio wherein the ratio of the radial width e normal to the plane of the blade body to the radial spacing f, falls within a range of 0.25 to 0.75.

A further radial plenum 19 follows, followed by pins 20, i.e., rows of ribs which are designed as simple webs and permit as uniform a distribution of the cooling-air flow as possible at the trailing edge 21. In this case, the spacing ratio (diameter g to radial spacing h) of the pins 20 lies within a range of 0.25 to 0.7.

A further row of ribs 24 is now located directly at the trailing edge so as to terminate flush with the latter. In this case, the row of rear ribs is dimensioned in such a way that the choking of the cooling-air flow of the entire effective cooling passage cross section is effected by the passages 25 between the so-called choke ribs 24. Owing to the fact that the choking is effected at the trailing edge 21 and with such a row of choke ribs 24, a number of advantages are obtained:

The effective choke cross section can easily be measured at the outlet edge.

Only one choke point is obtained exactly at the trailing edge, instead of two choke points at the end of the ribs and the trailing edge.

Inaccuracies in the choke region which possibly arise during the casting process can easily be reworked, since the choke points are accessible from outside.

The choke cross section can easily be varied if required.

The arrangement of the ribs right at the end of the blade leads to increased stability of the separation edge, and thus foreign bodies in the working air flow do less damage to the trailing edge and the cooling of the component is not impaired as much by such deformations.

Such a blade is usually produced by a casting process, such as an investment casting process. In this casting process, however, the effective choke cross section cannot easily be placed directly at the outlet edge during production. The abrupt widening in the cross section at the outlet in the casting core could lead to a considerable increase in core fractures during production. However, this can be avoided by leaving a projecting length during the casting process. In this case, the cooling geometry reproduced in the core is extended beyond the actual boundary of the component. FIG. 2*b*) shows the edge region of such an element extended beyond the trailing edge by the value b. Ribs are advantageously no longer arranged in the region of the projecting length. The transition from the choke geometry then does not coincide with the core mounting, but rather a transition from the choke geometry to a continuous radial passage first of all takes place inside the extended component, and this transition may then be used as core mounting without the risk of core fractures. Depending on the process, this transition may be designed in many different ways in an optimum manner for the core mounting, i.e., it is not necessary for the two walls to simply be extended evenly toward the rear as shown in FIG. 2*b*); for example, a gradual projecting expansion, or narrowing or thickening, of the walls in the region of the projecting length is also conceivable. The projecting geometry is reworked, i.e., removed, to the desired length of the trailing edge after the casting, so that the choke points coincide with the trailing edge. This may be done, for example, together with reworking which is normally subsequently necessary, such as electrical discharge machining and laser drilling of the film cooling holes 13–15.

In the exemplary embodiment specified, the trailing edge usually has a thickness d within a range of 0.5 to 8 mm, preferably within a range of 1.0 to 2.5 mm. The slot thickness c of the cooling-air passage is usually within a range of 0.3 to 2.0 mm, preferably within a range of 0.8 to 1.5 mm. In order to be able to effectively avoid core fractures during the casting process, the projecting length b beyond the trailing edge, in particular in the case of the above dimensioning, should be 0.5 to 5 times, preferably 1 to 3 times, the length a of the choke ribs 24; it is especially advantageous if the projecting length b is the same as the length a of the choke ribs.

What is claimed is:

1. A gas-turbine guide element for directing the flow of hot air, said gas turbine guide element comprising:

a trailing edge region at which air flow separates from the guide element, said trailing edge region including at least two walls arranged approximately parallel to each other and connected to each other by a plurality of ribs;

internal cooling passages being defined between said ribs, said internal cooling passages being adapted for carrying cooling medium for cooling said guide element through the cooling passages and discharging the cooling medium from the guide element at the trailing edge region essentially parallel to and between said walls;

at least some of said ribs being arranged so as to terminate approximately flush with a trailing edge of the trailing edge region;

said ribs arranged to terminate approximately flush with the trailing edge are choke ribs and a rate of flow of cooling medium through the guide element is a function of the dimensioning of the internal cooling passages defined between the choke ribs; and the choke ribs each have a width (e) parallel to the trailing edge and are arranged at a distance apart from center-to-center by a rib spacing (f), such that the ratio of width (e) to rib spacing (f) is within a range of approximately 0.35 to 0.75.

2. The guide element according to claim 1, wherein a thickness (d) of the guide element at the trailing edge is within a range of approximately 0.5 to 5 mm, and a thickness (c) of the internal cooling-air passages between the walls at the trailing edge is within a range of approximately 0.3 to 2 mm.

3. The guide element according to claim 1 wherein the guide element is designed as a guide blade arranged in front of a turbine rotor, and the cooling medium used is air.

4. The guide blade according to claim 3, further including:

an incident-flow region that is wider than the trailing edge region, the incident-flow region including an inner, central, radially running insert and suction side and pressure-side cooling passages defined around the insert for directing the flow of the cooling air;

a plurality of ribs adjoining the insert, intermediate ribs, and pins located between the walls and further defining the internal cooling passages for directing the flow of the cooling air before it discharges from the guide blade through outlet openings at the trailing edge.

5. The guide element according to claim 1, wherein a thickness (d) of the guide element at the trailing edge is within a range of approximately 1.0 to 2.5 mm, and a thickness (c) of the internal cooling-air passages between the walls at the trailing edge is within a range of approximately 0.8 to 1.5 mm.

6. A method of producing a gas-turbine guide element, said gas turbine guide element having a trailing edge region at which air flow separates from the guide element, said trailing edge region including at least two walls arranged approximately parallel to each other and connected to each other by a plurality of ribs, internal cooling passages being defined between said ribs, said internal cooling passages being adapted for carrying cooling medium for cooling said guide element through the cooling passages and discharging the cooling medium from the guide element at a trailing edge of the trailing edge region essentially parallel to and between said walls, said method comprising:

producing the guide element by a casting process, wherein the trailing edge region is cast with a projecting length extending the walls of the guide element in the direction of flow; and removing the projecting length after the casting such that at least some of the ribs are arranged as choke ribs terminating approximately flush with the trailing edge.

7. The method according to claim 6, wherein dimensions of outlet openings between the choke ribs are selected based on a desired rate of flow of cooling medium through the finished guide element.

8. The method according to claim 6, wherein the casting process is a pressure casting process; and the projecting length extends a distance (b) behind the trailing edge, and the walls are spaced a distance (c) apart at the trailing edge such that (b)/(c) falls within the range of approximately 0.5 to 5.

9. The method according to claim 6, wherein the choke ribs have a width (e) parallel to the trailing edge and are arranged at a distance apart from center-to-center by a rib spacing spacing (f), such that the ratio of width (e) to rib spacing (f) is within a range of approximately 0.25 to 0.75;

the thickness (d) of the guide element at the trailing edge is within a range of 0.5 to 5 mm; and the slot thickness (c) of the cooling-air passages between the walls at the trailing edge is within a range of 0.3 to 2 mm.

10. The method according to claim 6, wherein the guide element is a guide blade arranged in front of a turbine rotor, and the cooling medium used is air.

11. The method according to claim 6, wherein the choke ribs have a width (e) parallel to the trailing edge and are arranged at a distance apart from center-to-center by a rib spacing (f), such that the ratio of width (e) to rib spacing (f) is within a range of approximately 0.25 to 0.75;

the thickness (d) of the guide element at the trailing edge is within a range of 1.0 to 2.5 mm; and the slot thickness (c) of the cooling-air passages between the walls at the trailing edge is within a range of 0.8 to 1.5 mm.

* * * * *